US011066891B2

(12) United States Patent
Smith et al.

(10) Patent No.: US 11,066,891 B2
(45) Date of Patent: Jul. 20, 2021

(54) RAM BLOCK INNER SEAL ASSEMBLY AND SEAL THEREFORE

(71) Applicant: Nexus Energy Technologies Inc., Red Deer County (CA)

(72) Inventors: Ryan Smith, Red Deer (CA); Jeff Vert, Bentley (CA); Nathan Mahoney, Red Deer (CA)

(73) Assignee: Nexus Energy Technologies Inc., Red Deer County (CA)

( * ) Notice: Subject to any disclaimer, the term of this patent is extended or adjusted under 35 U.S.C. 154(b) by 0 days.

(21) Appl. No.: 16/120,035

(22) Filed: Aug. 31, 2018

(65) Prior Publication Data

US 2020/0072013 A1 Mar. 5, 2020

(51) Int. Cl.
*E21B 33/06* (2006.01)

(52) U.S. Cl.
CPC ..... *E21B 33/061* (2013.01); *E21B 33/06* (2013.01); *E21B 33/062* (2013.01)

(58) Field of Classification Search
CPC ..... E21B 2033/005; E21B 33/062; E21B 33/061; E21B 33/06
See application file for complete search history.

(56) References Cited

U.S. PATENT DOCUMENTS 1,812,297 A * 6/1931 Jensen ..... E21B 33/062 277/325
1,834,921 A * 12/1931 Abercrombie ..... E21B 33/062 251/1.3
1,861,614 A * 6/1932 Schweitzer ..... E21B 33/062 277/325
1,963,683 A * 6/1934 Shaffer ..... E21B 33/062 251/1.3
2,113,529 A * 4/1938 Hild ..... E21B 33/062 277/325
3,917,293 A * 11/1975 Lewis ..... E21B 33/06 277/327
6,394,460 B1 * 5/2002 Leggett ..... E21B 33/062 277/324

* cited by examiner

*Primary Examiner* — Umashankar Venkatesan
(74) *Attorney, Agent, or Firm* — Sander G. Gelsing

(57) ABSTRACT

In one aspect there is provided a ram block inner seal assembly comprising a core member having a top face, a bottom face, a front face, a rear face, and two side faces. A connector portion connects the top and bottom faces. A peripheral member surrounds the front, rear and side faces. The core member further comprises a peripheral groove on at least the front and side faces, the peripheral groove having a cross-sectional profile. The peripheral member further comprises an energizing section that has a cross-sectional profile which substantially matches the cross-sectional profile of the peripheral groove.

6 Claims, 9 Drawing Sheets

RAM BLOCK INNER SEAL ASSEMBLY AND SEAL THEREFORE

FIELD OF THE INVENTION

This invention relates generally to seal assemblies. More particularly, the invention relates to a seal assembly for use within a blowout preventer (BOP).

BACKGROUND OF THE INVENTION

The background information discussed below is presented to better illustrate the novelty and usefulness of the present invention. This background information is not admitted prior art.

A blowout preventer (BOP) is a specialized valve or similar mechanical device used to seal, control and monitor oil and gas wells to prevent a blowout, i.e. prevent the uncontrolled release of crude oil and/or natural gas from a well. A ram-type BOP uses a pair of split seal opposing steel plungers or rams. These rams, or ram blocks, extend toward the center of the wellbore to restrict flow, or retract open in order to permit flow. The rams are typically fitted with packers (e.g. rubber or elastomeric seals) that press against each other, against the wellbore, and around any tubing, tubulars, wire line or other wellbore tools or equipment running through the wellbore, so as to facilitate the sealing of the wellbore. Each individual ram block may have multiple seals or packers, such as inner seals and outer seals (see FIGS. 1*a*-1*c*).

Rams, or ram blocks, may be of different types: including pipe, blind, slips, shear, blind shear or a combination thereof. Pipe rams close around a drill pipe, restricting flow in the annulus between the outside of the drill pipe and the wellbore, but do not obstruct flow within the drill pipe. See FIGS. 1*a*-1*b* for an example of a pipe ram. Blind rams (also known as sealing rams) have no openings for tubing and can seal off the well when the well does not contain a drill string or other tubing. See FIG. 1*c* for an example of a blind ram.

When using a BOP to seal around coiled tubing, and regardless of the type of ram, it is common industry practice to apply a very large force into the ram's elastomeric seals or packers, especially the inner seals, to compress, energize and deform them around the coiled tubing and thereby generate a pressure tight seal. This is typically done via hydraulics and allows the BOP to seal off high wellbore pressures. Typically a ram's inner seal will be comprised of a block of rubber sandwiched between two metal plates, often referred to as top and bottom plates (see FIGS. 2*a*-2*d*). These metal plates are typically bonded to the rubber and therefore "float" with respect to the rubber block.

The inner seal resides within the ram block, which guides it and applies movement within the BOP. The ram block typically also centralizes any tubular that may be within the BOP. The rubber of the inner seal extends past the periphery of the metal plates on all sides (see FIGS. 2*a*-2*d*), so that it can generate a seal on its outer surface(s). When compressed the rubber block is deformed around any tubular that may be within the BOP (e.g. a pipe ram sealing around a section of coiled tubing). As a pair of opposing ram blocks in a BOP are actuated, the inner seals of each ram block contact one another. This interference energizes the rubber of both inner seals in multiple directions and makes a pressure seal. This energization of the rubber block of the inner seals is then typically also directed into the outer seal of the ram block, so that the outer seal will also make an appropriate pressure seal. Any pressure within the well bore then typically compounds these forces, pushing the ram blocks together, creating a tighter seal and energizing the rubber even more.

When such opposing ram blocks are closed onto one another, the pressure rating of the seal (and of the BOP) is directly related to the amount of force applied to the ram blocks by the actuators (e.g. hydraulic actuators). As higher pressure rated BOPs are required, this force is increased accordingly. Currently, it has been observed that at the higher pressure ratings, the force or pressure generated within the rubber blocks is so great that these blocks are spreading apart, forcing the metal plates apart from each other thereby deforming the interior of the ram block that houses or constrains the inner seal. This spreading is detrimental to the entire BOP system and can lead to BOP failure, causing major damage, including to the ram blocks, often distorting the cavity that accepts the inner seal assembly. Additionally, it has been observed that conventional BOP inner seals typically only have about a 3 pressure cycle (open/close) lifespan when used at or near their maximum working pressure rating, i.e. after being used three times to create a high pressure seal, the rubber block of the inner seals has spread or expanded beyond acceptable limits, and the inner seals will need to be replaced. This problem is now exacerbated as higher and higher wellbore and sealing pressures become more common in the oilfield.

Therefore, what is needed is an inner seal for a BOP ram block that can withstand great forces from a BOP's actuators and delivery reliable and consisted sealing at very high wellbore pressures, across a greater pressure cycle lifespan.

SUMMARY OF THE INVENTION

In an embodiment of the invention, there is provided a ram block inner seal assembly comprising a core member having a top face, a bottom face, a front face, a rear face, and two side faces. A connector portion connects the top and bottom faces. A peripheral member surrounds the front, rear and side faces. The core member further comprises a peripheral groove on at least the front and side faces, the peripheral groove having a cross-sectional profile. The peripheral member further comprises an energizing section that has a cross-sectional profile which substantially matches the cross-sectional profile of the peripheral groove.

In another embodiment of the invention, there is provided a ram block inner seal assembly, for use with a blowout preventer (BOP) to facilitate sealing of a wellbore. In that embodiment, the ram block inner seal assembly comprises a core member having a top face, a bottom face, a front face, a rear face, two side faces, and a connector portion connecting the top and bottom faces. A peripheral member surrounds substantially all of the front, rear and side faces. The peripheral member is comprised of a suitable material to provide the ram block inner seal assembly with sufficient wellbore sealing characteristics to enable sealing of the BOP against typical wellbore pressures, when the ram block inner seal assembly is used within the BOP to seal off a wellbore.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF THE PREFERRED EMBODIMENTS

Figures 1A, 1B:
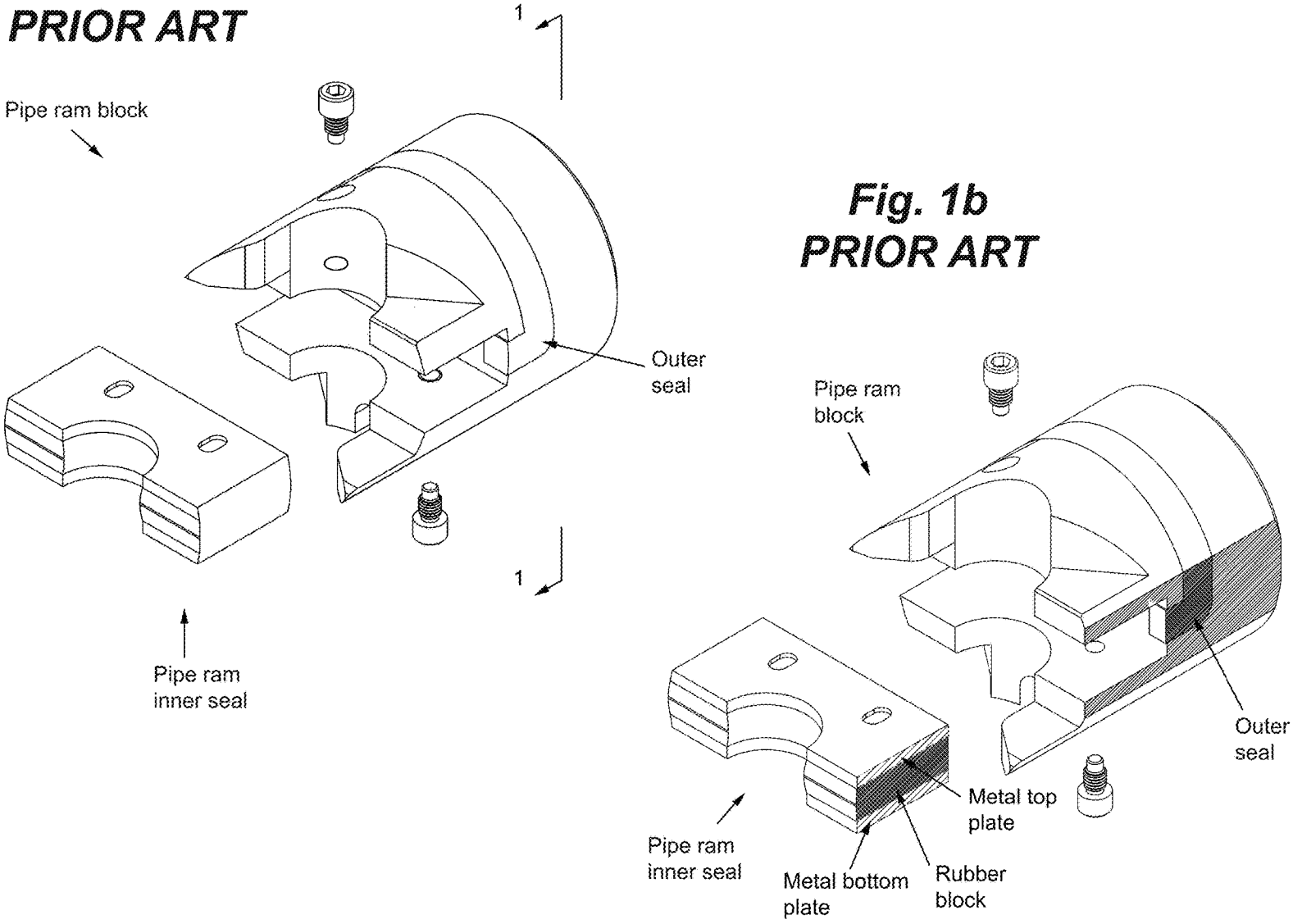
Fig. 1a PRIOR ART
Fig. 1b PRIOR ART
FIG. 1*a* is an exploded perspective view of a PRIOR ART pipe ram.
FIG. 1*b* is an exploded, sectioned perspective view of the PRIOR ART pipe ram of FIG. 1*a*, taken along line 1-1.
Figure 1C:
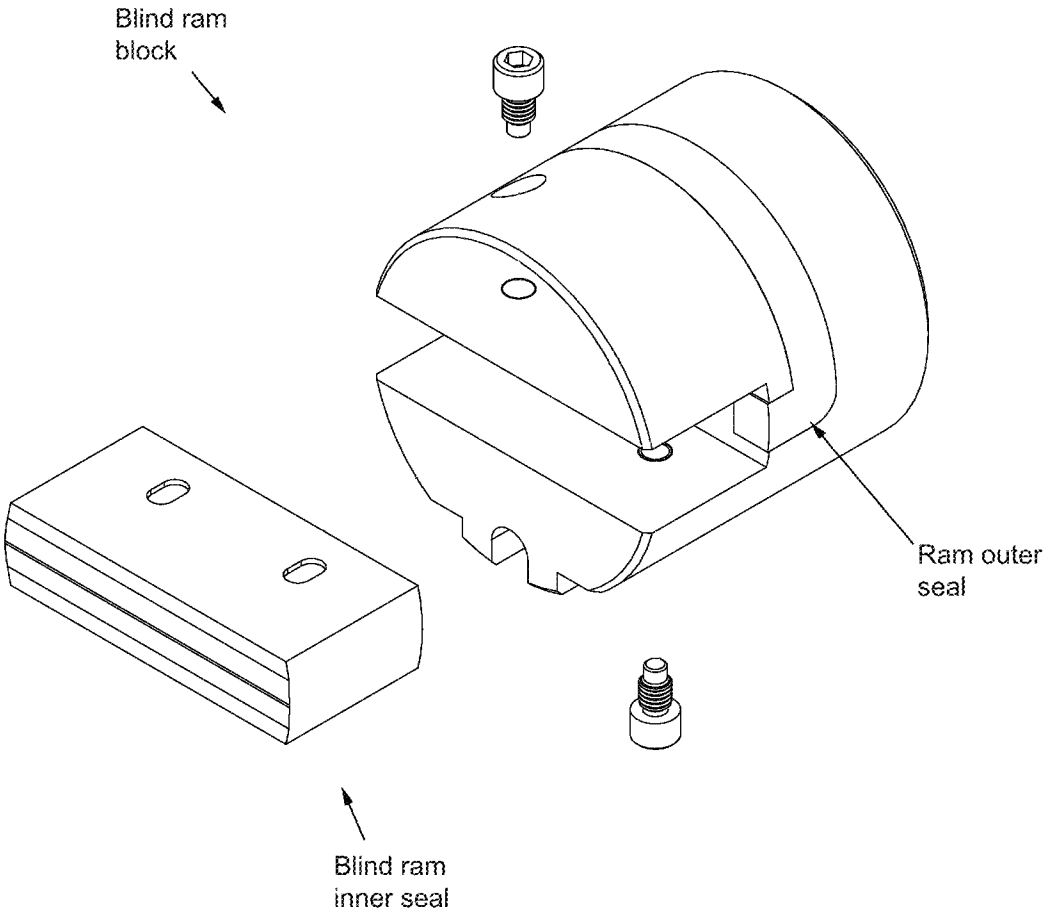
Fig. 1c PRIOR ART
FIG. 1*c* is an exploded perspective view of a PRIOR ART blind ram.
Figure 2C:
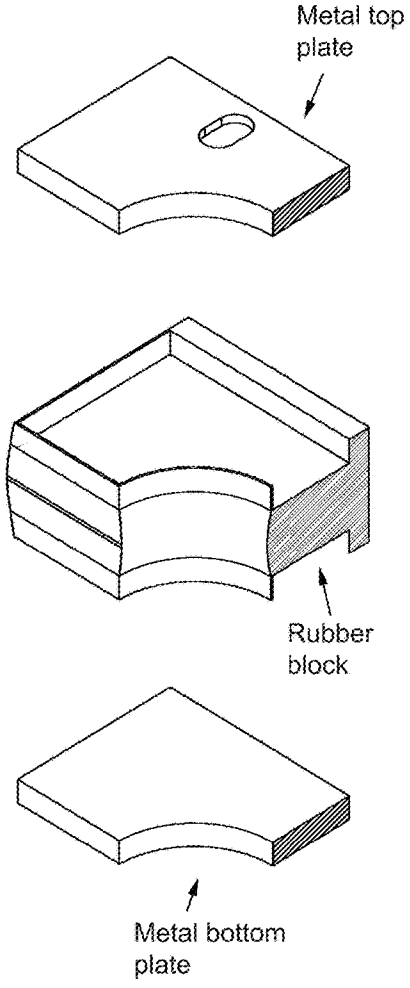
Fig. 2c PRIOR ART
FIG. 2*c* is an exploded, sectioned perspective view of the PRIOR ART pipe ram inner seal of FIG. 2*a*, taken along line 2-2 in FIG. 2*b;*
Figure 2B:
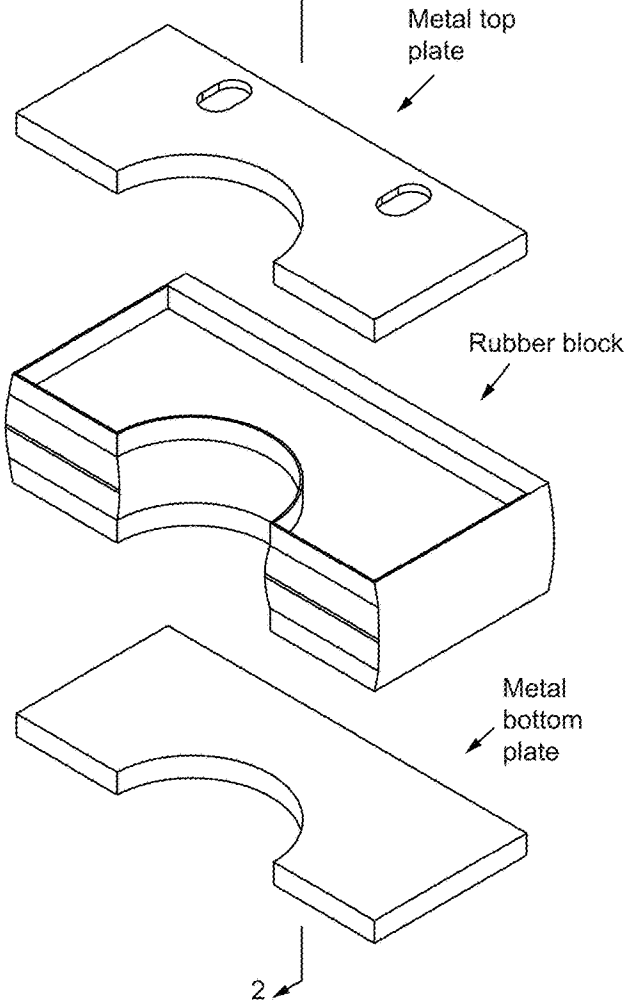
Fig. 2b PRIOR ART
FIG. 2*b* is an exploded perspective view of the PRIOR ART pipe ram inner seal of FIG. 2*a;*
Figure 2A:
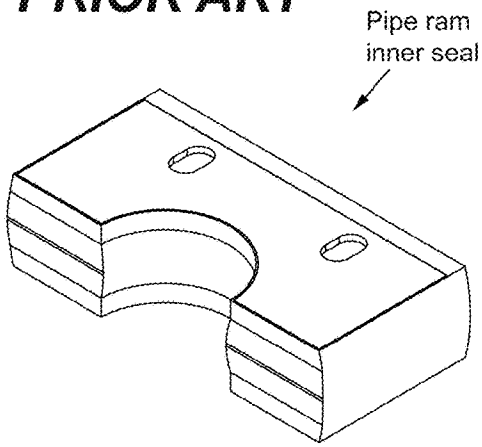
Fig. 2a PRIOR ART
FIG. 2*a* is a perspective view of a PRIOR ART pipe ram inner seal.
Figure 2D:
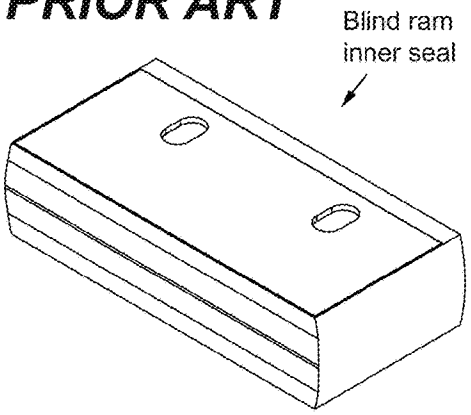
Fig. 2d PRIOR ART
FIG. 2*d* is a perspective view of a PRIOR ART blind ram inner seal.

The following description is of preferred embodiments by way of example only and without limitation to the combination of features necessary for carrying the invention into effect. Reference is to be had to the Figures in which identical reference numbers identify similar components. The drawing figures are not necessarily to scale and certain features are shown in schematic or diagrammatic form in the interest of clarity and conciseness.

A first embodiment of the ram block inner seal assembly 10 of the present invention is shown in FIGS. 3*a*-3*g* and comprises a core member 20 and a peripheral member 30 that surrounds the core member 20. The core member 20 is preferably a substantially solid member made from metal, steel or any other suitable material that provides adequate strength, durability and rigidity to support the various loads that may be encountered by the assembly 10 during operation in a blowout preventer (BOP). The peripheral member 30 is preferably elastomeric and made from natural rubber, polyisoprene, polybutadiene, polyisobutylene, polyurethane, or other suitable material to provide the desired sealing and energizing characteristics typically associated with rubber blocks in conventional inner seals, so as to enable the ram block inner seal assembly 10 to facilitate or enable sealing of the BOP against common or typical wellbore pressures; e.g. by sealing around a section of tubing, and/or by sealing against a second, opposingly oriented ram block inner seal assembly. More preferably, peripheral member 30 is a substantially band- or ribbon-like member that surrounds the periphery of the core member 20, as further described below.

Figure 3B:
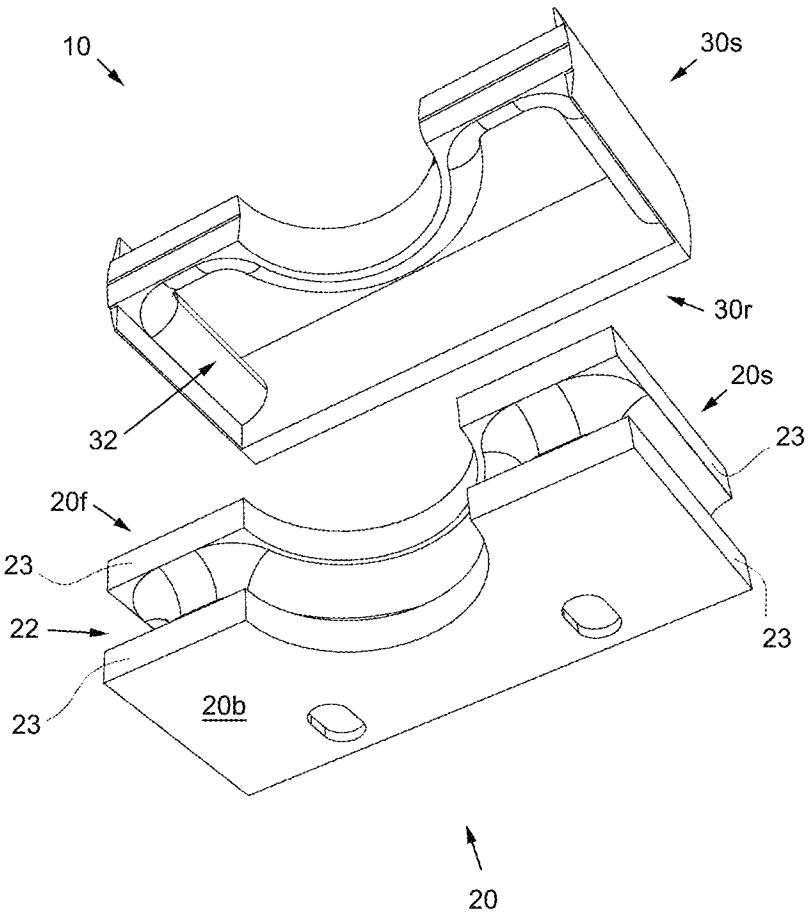
FIG. 3*b* is an exploded bottom perspective view of the ram block inner seal assembly of the embodiment of FIG. 3*a;*
Figure 3A:
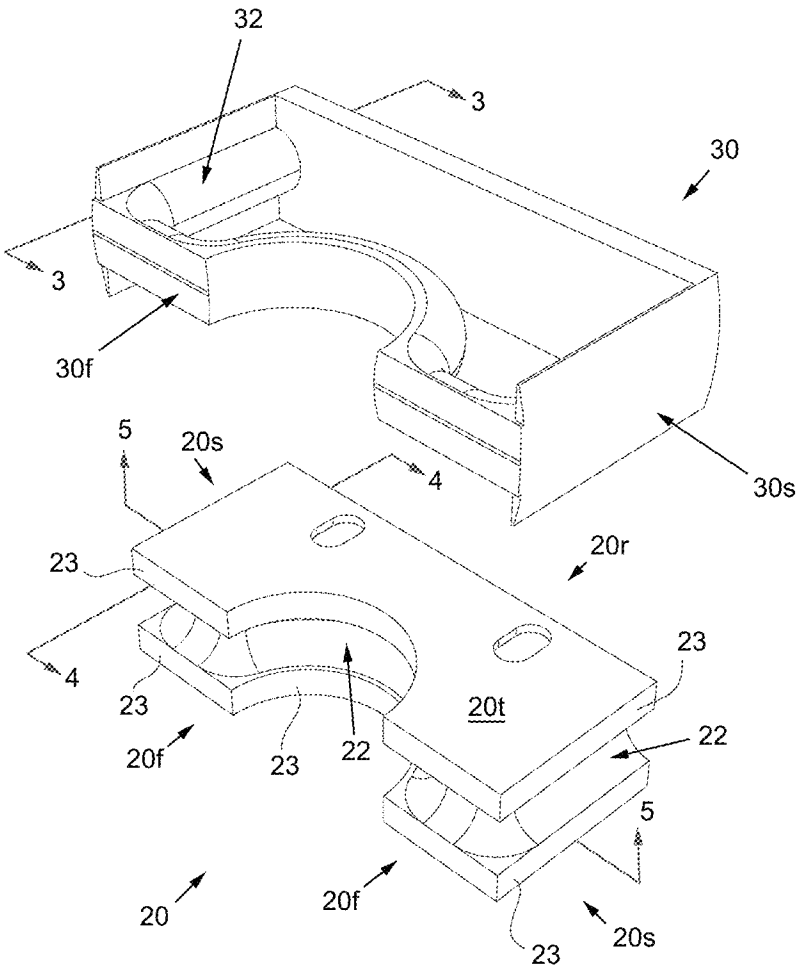
FIG. 3*a* is an exploded top perspective view of one embodiment of a ram block inner seal assembly of the present invention.

The core member 20 preferably comprises a top face 20*t*, a bottom face 20*b*, a front face 20*f*, a rear face 20*r*, and two side faces 20*s* (see FIGS. 3*a* and 3*b*). The core member 20 preferably also comprises a peripheral groove 22 on the front and side faces 20*f*, 20*s*, and a connector portion 24 connecting said top face 20*t* and bottom face 20*b* (see FIGS. 3*c* and 3*d*). More preferably, the connector portion 24 is a solid, or substantially solid, central mass portion comprising the bulk of the core member 20. Advantageously, a solid or substantially solid core member 20, with only a peripheral groove 22 on the front and side faces 20*f*, 20*s*, strengthens the assembly 10, allows it to withstand higher wellbore pressures, increases cycle life, and reduces the amount of expensive rubber or elastomeric material required to manufacture an assembly 10.

Figure 5B:
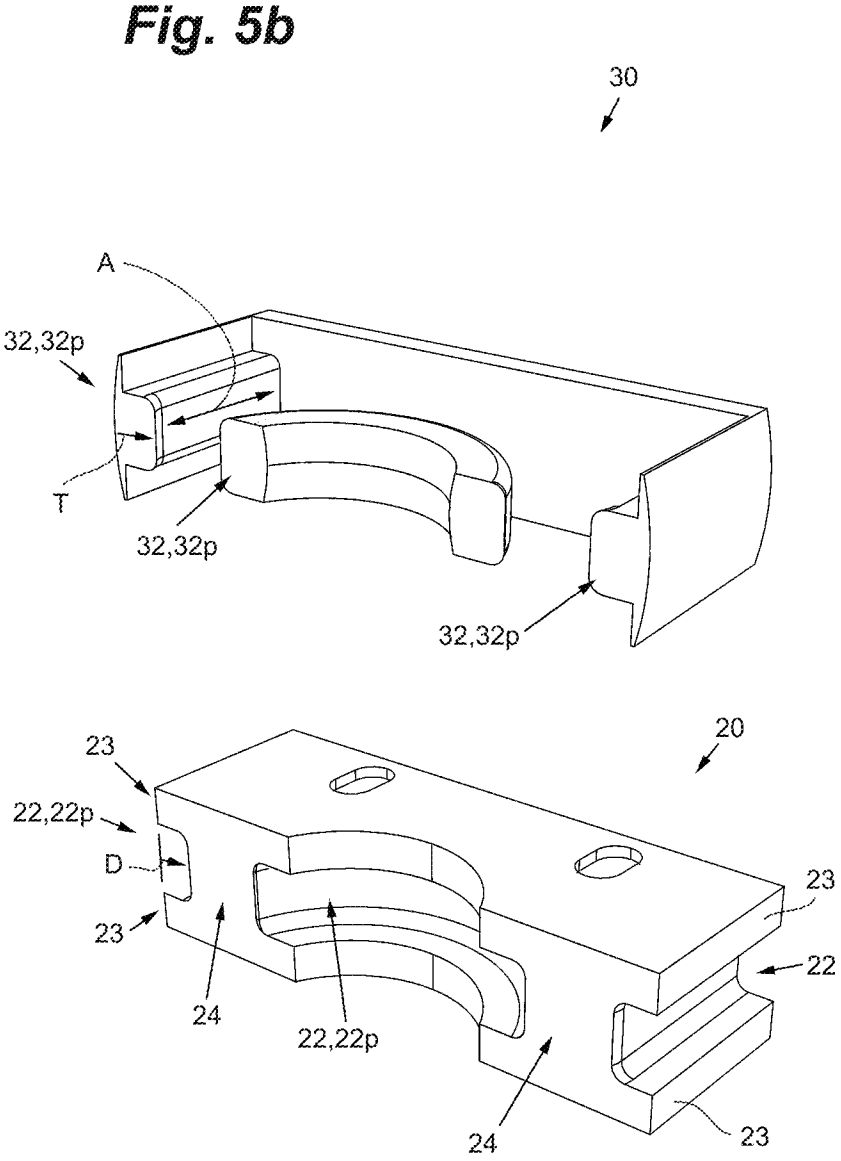
FIG. 5B is an exploded, sectioned perspective view of the ram block inner seal assembly of the embodiment of FIG. 5*a*, taken along line 8-8.
Figure 5A:
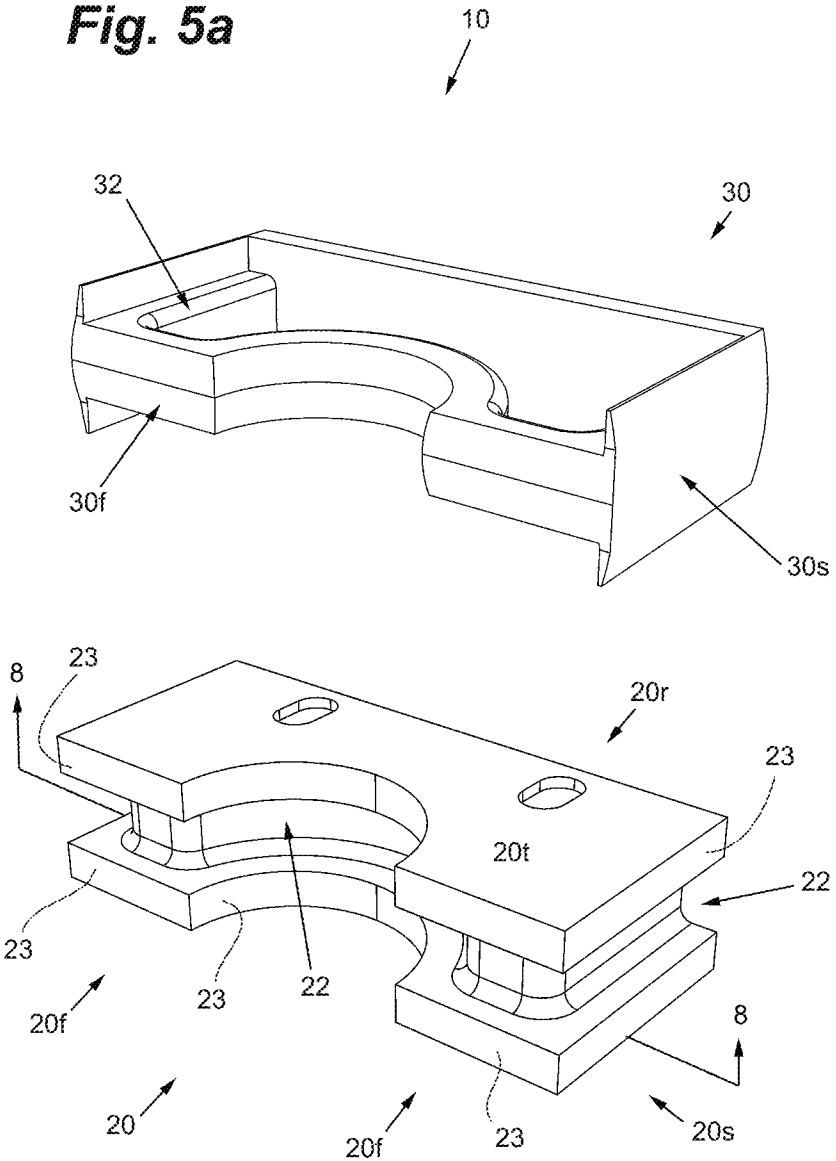
FIG. 5*a* is an exploded perspective view of yet another embodiment of a ram block inner seal assembly of the present invention.

The peripheral groove 22 is preferably defined by groove edges 23 on the front and side faces 20*f*, 20*s*. Even more preferably, the peripheral groove 22 has a cross-sectional profile 22*p*, e.g. a semicircular cross-section profile 22*p* wherein the maximum depth D of the groove 22 is then the radius of the semicircle (see FIG. 3*d*). It should be noted that a groove 22 with a different cross-sectional profile 22*p* (e.g. a square or rectangular cross-sectional profile between groove edges 23, or a squircle or rounded-rectangle cross-sectional profile) will also work; see, for example, the embodiment of FIGS. 5*a*-5*b*. Even more preferably, the core member 20, along with the peripheral groove 22 and groove edges 23, is machined from a solid piece of metal or steel (e.g. via CNC machining).

The elastomeric, peripheral member 30 preferably surrounds all, or substantially all, of the front, rear and side faces 20*f*, 20*r*, 20*s* of the core member 20 in a close-fitting arrangement (as shown in the Figures). As such, the elastomeric, peripheral member 30 will likewise further comprise a front face 30*f*, rear face 30*r* and side faces 30*s*. Preferably, the elastomeric, peripheral member 30 further comprises an enlarged or thickened energizing section or energization pathway 32 that: (i) extends radially inward from said front face 30*f* and side faces 30*s*, partially towards a centre point of peripheral member 30, and (ii) has a cross-sectional profile 32*p* that substantially matches the cross-sectional profile 22*p* of the groove 22 of the core member 20. More preferably, energizing section 32 further comprises an energizing axis A which runs between front face 30*f* and rear face 30*r*, along one or both side faces 30*s*. When assembled into the assembly 10 energizing axis A is then positioned substantially within groove 23 along the core member's side faces 20*s* and between top and bottom faces 20*t*, 20*b*, substantially co-planar therewith (see FIGS. 3*c*-3*d*).

Figure 3D:
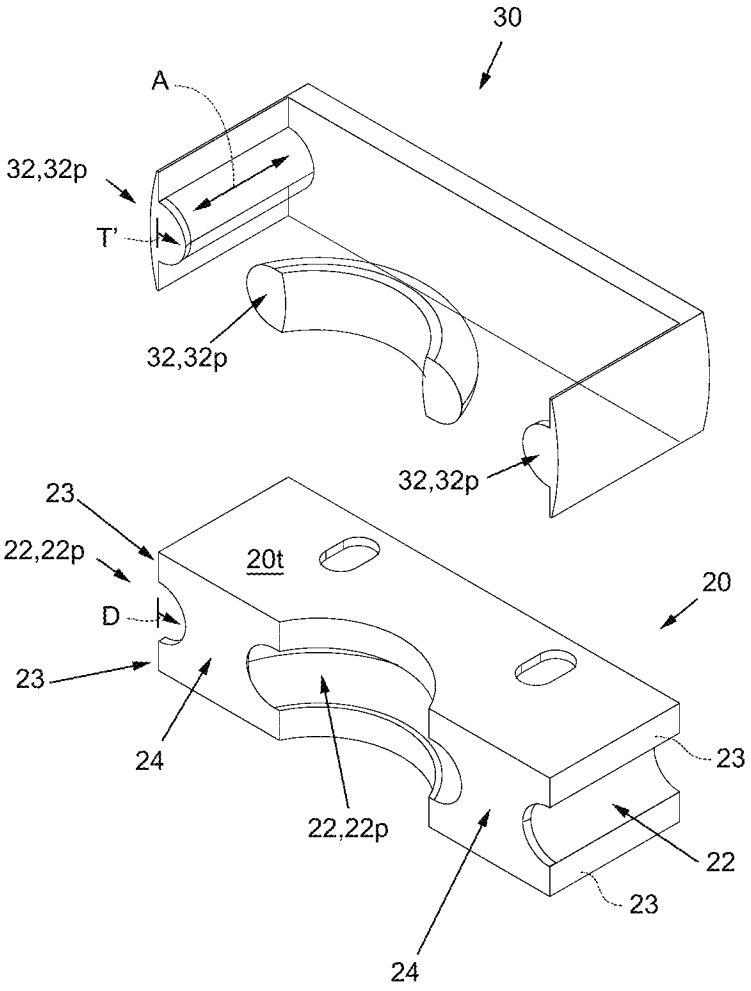
FIG. 3*d* is an exploded, sectioned, top perspective view of the ram block inner seal assembly of the embodiment of FIG. 3*a*, taken along line 5-5.
Figure 3C:
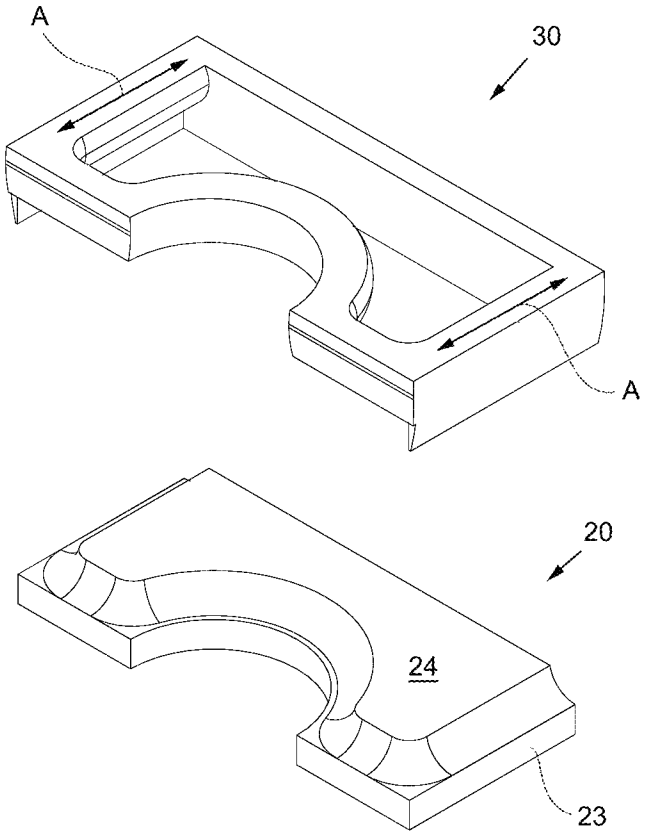
FIG. 3*c* is an exploded, sectioned, top perspective view of the ram block inner seal assembly of the embodiment of FIG. 3*a*, taken along lines 3-3 and 4-4 in FIG. 3*a;*
Figure 3F:
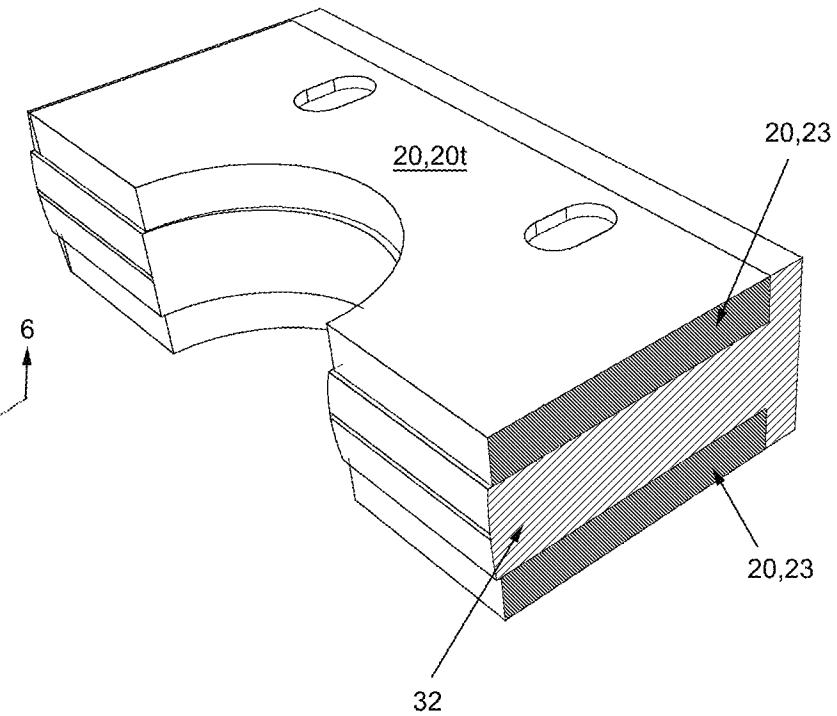
FIG. 3*f* is a sectioned perspective view of the ram block inner seal assembly of the embodiment of FIG. 3*a*, taken along line 6-6 in FIG. 3*e;*
Figure 3E:
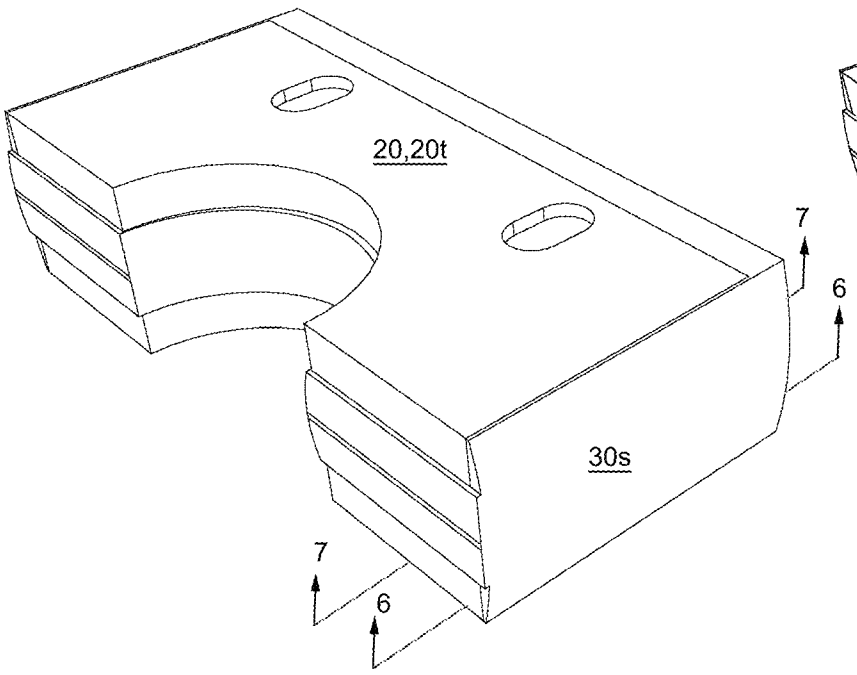
FIG. 3*e* is a perspective view of the ram block inner seal assembly of the embodiment of FIG. 3*a;*
Figure 3G:
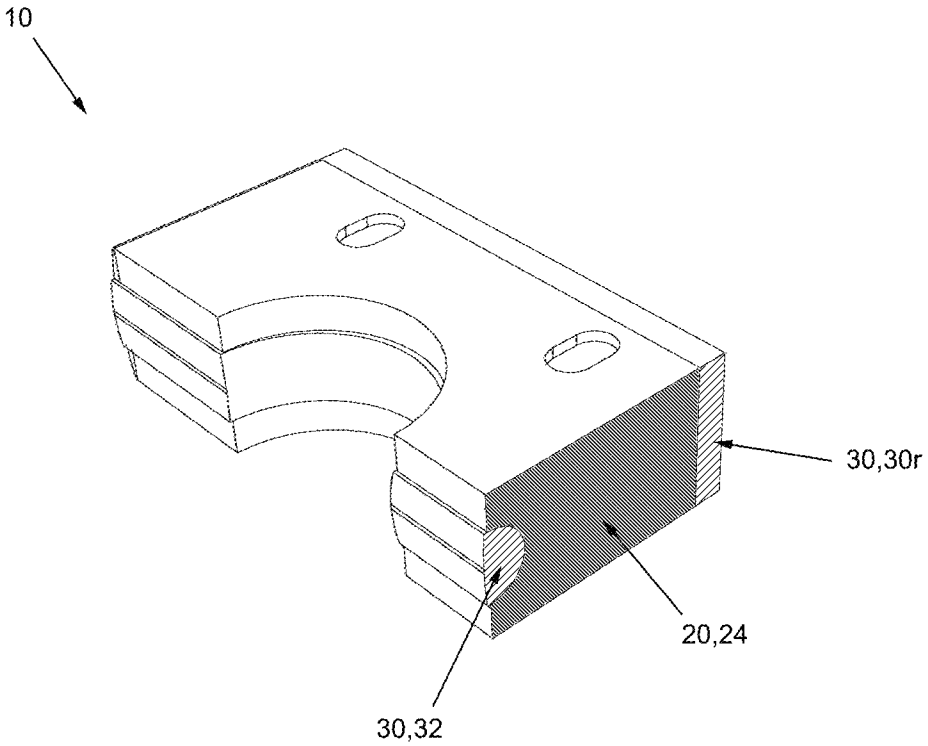
FIG. 3*g* is a sectioned perspective view of the ram block inner seal assembly of the embodiment of FIG. 3*a*, taken along line 7-7 in FIG. 3*e;*
Figure 4B:
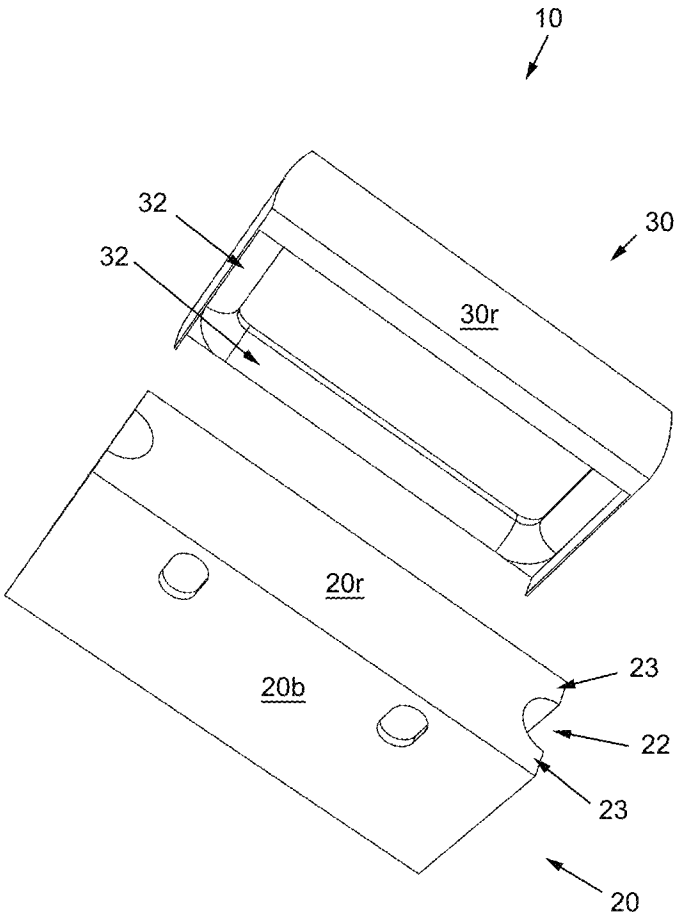
FIG. 4*b* is an exploded bottom perspective view of the ram block inner seal assembly of the embodiment of FIG. 4*a;*
Figure 4A:
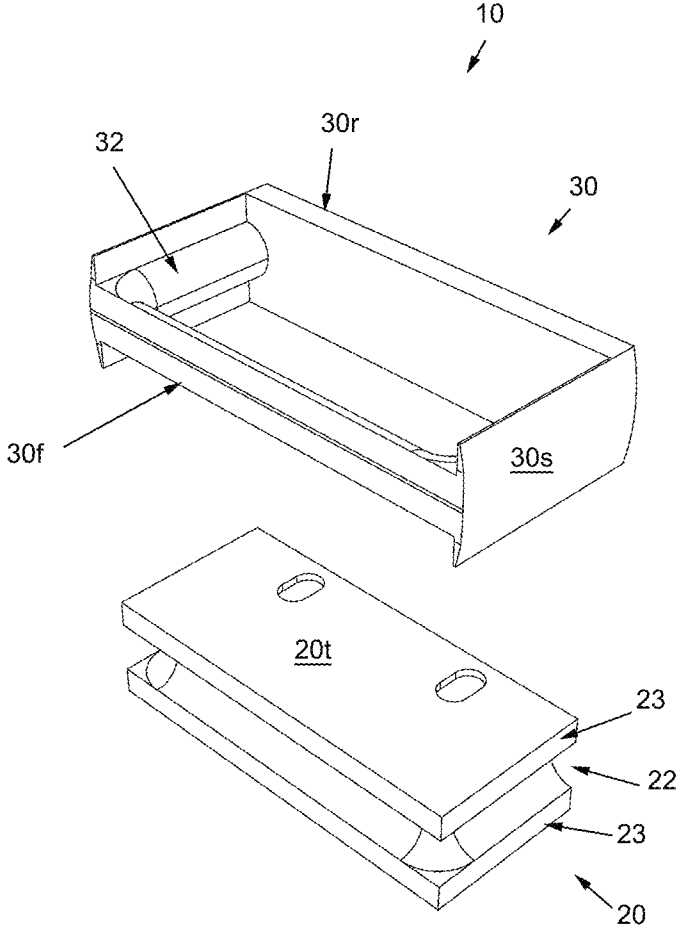
FIG. 4*a* is an exploded top perspective view of another embodiment of a ram block inner seal assembly of the present invention.

As such, in embodiments of the assembly 10 where the peripheral groove 22 has a semicircular cross-sectional profile 22*p* and a maximum depth D, then the energizing section 32 will have a corresponding semicircular cross-sectional profile 32*p* and a corresponding maximum thickness T to match the groove's depth D (see FIG. 3*d*). In other embodiments (not shown), the elastomeric, peripheral member 30 further comprises an enlarged or thickened energizing section or energization pathway 32 that extends radially inward from, not only the front face 30*f* and side faces 30*s*, but also the rear face 30*r*.

The use of "top" and "bottom" are used herein as respective references to the orientation of the assembly 10 (and the core and peripheral members 20, 30) within a BOP positioned on a traditional substantially vertical well. The term "up" and "down" are then used with respect to the ground. More specifically, the term "up" may be used to describe a vector that is normal to the ground and away from the ground. More specifically, the term "down" may be used to describe a vector that is normal to the ground and pointing toward the ground. However, there may be uses of the present invention where the assembly 10 (and the core and peripheral members 20, 30) is used in different orientations, such as in a substantially horizontal orientation in a horizontal well drilling operation. In such a case, the term "down" is then used with respect to the downhole side of a BOP, while the term "up" is then used with respect to the opposite, uphole side of a BOP.

Similarly, the use of "front" and "rear" are used herein as respective references to the orientation of the assembly 10 (and the core and peripheral members 20, 30) within a BOP. The term "front" and "rear" are then used with respect to the central axis of the BOP, wherein "front" is then used with respect to that part of the member 20,30 most proximate to the central axis of the BOP, while the term "rear" is then used with respect to the opposite side of the member 20,30 that is most distal to the central axis of a BOP. For example, the front face 20*f* of the core member 20 would be that face of the member 20 closest to the BOP's central axis, while the rear face 20*r* is then that face of the member 20 furthest away from the BOP's central axis. When the assembly 10 is placed in a ram block of a BOP and actuated to close, the "front" side of the assembly 10 is the side most proximate to the BOP's central axis and is the side that will typically close against the "front" side of an opposing inner seal assembly and any tubular that may be in the BOP.

One way to manufacture the inner seal assembly 10 of the present invention is to machine the core member 20 from a solid piece of metal or steel (e.g. via CNC machining, as noted above), machine out the peripheral groove 22, position the core member 20 within a suitable mould, and then pour rubber or other elastomeric material within the mould so as to form the peripheral member 30 in place around the core 20. Alternatively, core member 20 may be cast, forged or moulded, using conventional techniques.

When an embodiment of the ram block inner seal assembly 10 of the present invention is utilized in a ram block of a blowout preventer (BOP), and the ram block is actuated (i.e. moved towards the BOP's axial center line) and forced closed against an opposing ram block and any tubular that may be in the BOP (e.g. if the ram block is a pipe ram block), the elastomeric member 30 will become energized to generate a pressure tight seal across its front, rear and side faces 30*f*, 30*r*, 30*s*. Some of the force from the closure of the ram blocks will also energize any energizing section 32 that is along the front and side faces 30*f*, 30*s*. The energizing section 32 will then allow a greater amount of that force be transmitted (through peripheral member 30) towards the rear face 30*r* of the peripheral member 30 (as compared to embodiments without said energizing section 32), and then energize any outer seal that may be in the ram block positioned against the rear face 30*r*.

Advantageously, the connector portion 24 of the core member 22 maintains a predetermined distance between the top face 20*t* and bottom face 20*b*, even during times when the inner seal assembly 10 is subject to the great forces used to energize the elastomeric, peripheral member 30 and generate a high pressure seal. Unlike the prior-art inner seal assemblies, where the metal plates "float" on the rubber block and where the generation of a high pressure seal and the force put into the rubber block spreads these metal plates apart and damages the ram block, the inner seal assembly 10 of the present invention does not have this defect. More advantageously, by limiting the elastomeric aspect of an inner seal assembly 10 to a peripheral member 30 (including any energizing section 32), the amount/volume of expensive rubber or elastomer required is significantly reduced as compared to prior-art inner seal assemblies. This very significantly reduces the cost associated with the manufacturing of such inner seal assemblies, since the elastomeric part is often much more expensive than any metal or steel used in the core member (or in the prior art metal plates).

Even more advantageously, by utilizing a semi-circular cross-section for profiles 22*p* and 32*p* any energizing forces experienced by the assembly 10 during creation of a pressure seal are deflected away from groove edges 23 and, instead, directed along energizing axis A (between front 30*f* and rear 30*r* faces), thereby further reducing any stress on the groove edges 23 and directing such forces along axis A to the rear face 30*f* and any outer seal that may be adjacent such rear face 30*f*. Advantageously, this design significantly reduces and eliminates rubber or elastomer from extruding along vertical axis of the assembly 10, but instead flows along (horizontal) axis A to energize the any outer seals.

Those of ordinary skill in the art will appreciate that various modifications to the invention as described herein will be possible without falling outside the scope of the invention. In the claims, the word "comprising" is used in its inclusive sense and does not exclude other elements being present. The indefinite article "a" before a claim feature does not exclude more than one of the features being present.

The embodiments of the invention in which an exclusive property or privilege is being claimed are defined as follows:

1. A ram block inner seal assembly, for use with a blowout preventer (BOP) having a single pair of opposing ram blocks to facilitate sealing of a wellbore, the ram block inner seal assembly comprising:

a core member (20) having a top face (20*t*), a bottom face (20*b*), a front face (20*f*), a rear face (20*r*), two side faces (20*s*), and a single, solid connector portion (24) connecting said top face (20*t*) and bottom face (20*b*); and a peripheral member (30) that surrounds substantially all of the front face (20*f*), the rear face (20*r*) and the two side faces (20*s*);

wherein the peripheral member (30) is comprised of a suitable material to provide the ram block inner seal assembly (10) with sufficient wellbore sealing characteristics to enable sealing of the BOP against typical wellbore pressures when said ram block inner seal assembly (10) is used with said BOP;

wherein a single pair of core members (20) can be placed within said single pair of opposing ram blocks; and wherein, when said BOP is actuated, said single pair of core members (20) cooperate to enable said sealing of the BOP.

2. The ram block inner seal assembly of claim 1 wherein the peripheral member (30) is elastomeric.

3. The ram block inner seal assembly of claim 1 wherein the core member (20) further comprises a peripheral groove (22) on said front face (20*f*) and said side faces (20*s*); and wherein said peripheral groove (22) has a semi-circular cross-sectional profile (22*p*), a maximum depth (D); and wherein the maximum depth (D) of said groove (22) is the radius of the semicircle.

4. The ram block inner seal assembly of claim 3 wherein the peripheral member (30) further comprises an energizing section (32) that:

(i) extends radially inward from said front face (30*f*) and side faces (30*s*) at least partially towards a centre point of peripheral member (30), and (ii) has a cross-sectional profile (32*p*) that substantially matches the semi-circular cross-sectional profile (22*p*) of the peripheral groove (22).

5. The ram block inner seal assembly of claim 4 wherein the energizing section (32) further comprises an energizing axis (A) which runs between front face (30*f*) and rear face (30*r*).

6. A ram block inner seal assembly comprising:

a core member (20) having a top face (20*t*), a bottom face (20*b*), a front face (20*f*), a rear face (20*r*), two side faces (20*s*), and a single, solid connector portion (24) connecting said top face (20*t*) and bottom face (20*b*); and an elastomeric peripheral member (30) that surrounds substantially all of the front face (20*f*), the rear face (20*r*) and the two side faces (20*s*);

wherein the core member (20) further comprises a peripheral groove (22) on said front face (20*f*) and said side faces (20*s*), said peripheral groove (22) having a semi-circular cross-sectional profile (22*p*) and a maximum depth (D);

wherein the maximum depth (D) of said groove (22) is the radius of the semicircle and wherein the peripheral member (30) further comprises an energizing section (32) having a cross-sectional profile (32*p*) that substantially matches the semi-circular cross-sectional profile (22*p*) of the peripheral groove (22).

* * * * *